US012590747B2

(12) United States Patent
Winckler et al.

(10) Patent No.: US 12,590,747 B2
(45) Date of Patent: Mar. 31, 2026

(54) FREEZE PREVENTION IN STAND-ALONE ICE MAKING APPLIANCE

(71) Applicant: Haier US Appliance Solutions, Inc., Wilmington, DE (US)

(72) Inventors: Rachel Winckler, Louisville, KY (US); Samuel Vincent DuPlessis, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 154 days.

(21) Appl. No.: 18/457,689

(22) Filed: Aug. 29, 2023

(65) Prior Publication Data

US 2025/0075958 A1 Mar. 6, 2025

(51) Int. Cl.
*F25C 1/25* (2018.01)
*F25C 1/147* (2018.01)

(52) U.S. Cl.
CPC ..... *F25C 1/25* (2018.01); *F25C 1/147* (2013.01); *F25C 2500/08* (2013.01)

(58) Field of Classification Search
CPC ..... F25C 1/25; F25C 1/147; F25C 2500/08; F25C 1/12; F25C 2400/14; F25D 2323/122
See application file for complete search history.

(56) References Cited

U.S. PATENT DOCUMENTS

| | | | | |
|---|---|---|---|---|
| 3,196,625 | A * | 7/1965 | Nicolaus | F25C 1/147 62/76 |
| 4,622,832 | A | 11/1986 | Hagen | |
| 4,881,378 | A | 11/1989 | Bryant | |
| 5,555,743 | A | 9/1996 | Hatanaka | |
| 5,586,439 | A | 12/1996 | Schlosser et al. | |
| 9,151,527 | B2 | 10/2015 | Boarman et al. | |
| 2012/0111048 | A1* | 5/2012 | Kim | F25C 1/10 62/340 |
| 2020/0182534 | A1* | 6/2020 | Scalf | G01F 23/00 |

FOREIGN PATENT DOCUMENTS

| | | | |
|---|---|---|---|
| CN | 1493834 | A | 5/2004 |
| EP | 2604954 | A2 | 6/2013 |
| JP | H11257811 | A | 9/1999 |
| KR | 102529281 | B1 | 5/2023 |

* cited by examiner

*Primary Examiner* — Cassey D Bauer
(74) *Attorney, Agent, or Firm* — Dority & Manning, P.A.

(57) ABSTRACT

An ice making appliance includes a casing, a water tank, and an ice maker with an inlet. The ice making appliances also includes a fitting comprising two or more ports, and a flexible tubing conduit that includes a tube extending from one port of the fitting and a tube extending from another port of the fitting. One of the ports of the fitting is in fluid communication with the water tank, and another port of the fitting is in fluid communication with the inlet of the ice maker. The tube of the flexible tubing conduit between the inlet of the ice maker and one of the ports of the fitting comprises an internal diameter greater than an internal diameter of the other tube between the other port of the flexible tubing conduit and the water tank.

10 Claims, 5 Drawing Sheets

FREEZE PREVENTION IN STAND-ALONE ICE MAKING APPLIANCE

FIELD OF THE INVENTION

The present subject matter relates generally to ice maker appliances, and more particularly to freeze prevention in ice making appliances that produce nugget ice.

BACKGROUND OF THE INVENTION

Ice makers generally produce ice for use by consumers, such as in beverages, for cooling food items, etc. Certain refrigerator appliances include ice makers for producing ice. The ice maker can be positioned within the appliance's freezer chamber and direct ice into an ice bucket where the ice is stored within the freezer chamber. Such refrigerator appliances can also include a dispensing system for assisting a user with accessing ice produced by the refrigerator appliance's ice maker.

Stand-alone ice makers have been developed and are separate from refrigerator appliances, providing independent ice supplies. Generally, liquid water is added to the stand-alone ice makers, and the ice makers operate to freeze the liquid water and form ice. However, a problem during the ice making process can occur where the liquid water within the stand-alone ice maker can freeze within critical components, preventing the stand-alone ice maker from operating correctly.

As such, improved stand-alone ice makers are desired in the art. In particular, cost-effective stand-alone ice makers that prevent the freezing of liquid water within the critical components would be advantageous.

BRIEF DESCRIPTION OF THE INVENTION

Aspects and advantages of the invention will be set forth in part in the following description, or may be apparent from the description, or may be learned through practice of the invention.

In one example embodiment, a stand-alone ice making appliance defines a vertical direction, a lateral direction, and a transverse direction. The vertical direction, the lateral direction, and the transverse direction are mutually perpendicular. The stand-alone ice making appliance includes a casing, a first water tank disposed within the casing, a second water tank in fluid communication with the first water tank, and a pump disposed within the casing. The pump is in fluid communication with the first water tank and the second water tank. The pump is operable to flow water from the first water tank to the second water tank. The stand-alone ice making appliance also includes an ice maker disposed within the casing. The ice maker includes an inlet. The stand-alone ice making appliance further includes a fitting with a first port, a second port below the first port in the vertical direction, and a third port between the first and second ports in the vertical direction. A flexible tubing conduit includes a first tube extending from the first port of the fitting, a second tube extending from the second port of the fitting, and a third tube extending from the third port of the fitting. The first port of the fitting is in fluid communication with the second water tank, the second port of the fitting is in fluid communication with the first water tank, and the third port of the fitting is in fluid communication with the inlet of the ice maker. The third tube of the flexible tubing conduit has an internal diameter greater than one or more of an internal diameter of the first tube and an internal diameter of the second tube.

In another example embodiment, an ice making appliance includes a casing, a water tank, and an ice maker with an inlet. The ice making appliances also includes a fitting comprising two or more ports, and a flexible tubing conduit that includes a tube extending from one port of the fitting and a tube extending from another port of the fitting. One of the ports of the fitting is in fluid communication with the water tank, and another port of the fitting is in fluid communication with the inlet of the ice maker. The tube of the flexible tubing conduit between the inlet of the ice maker and one of the ports of the fitting comprises an internal diameter greater than an internal diameter of the other tube between the other port of the flexible tubing conduit and the water tank.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
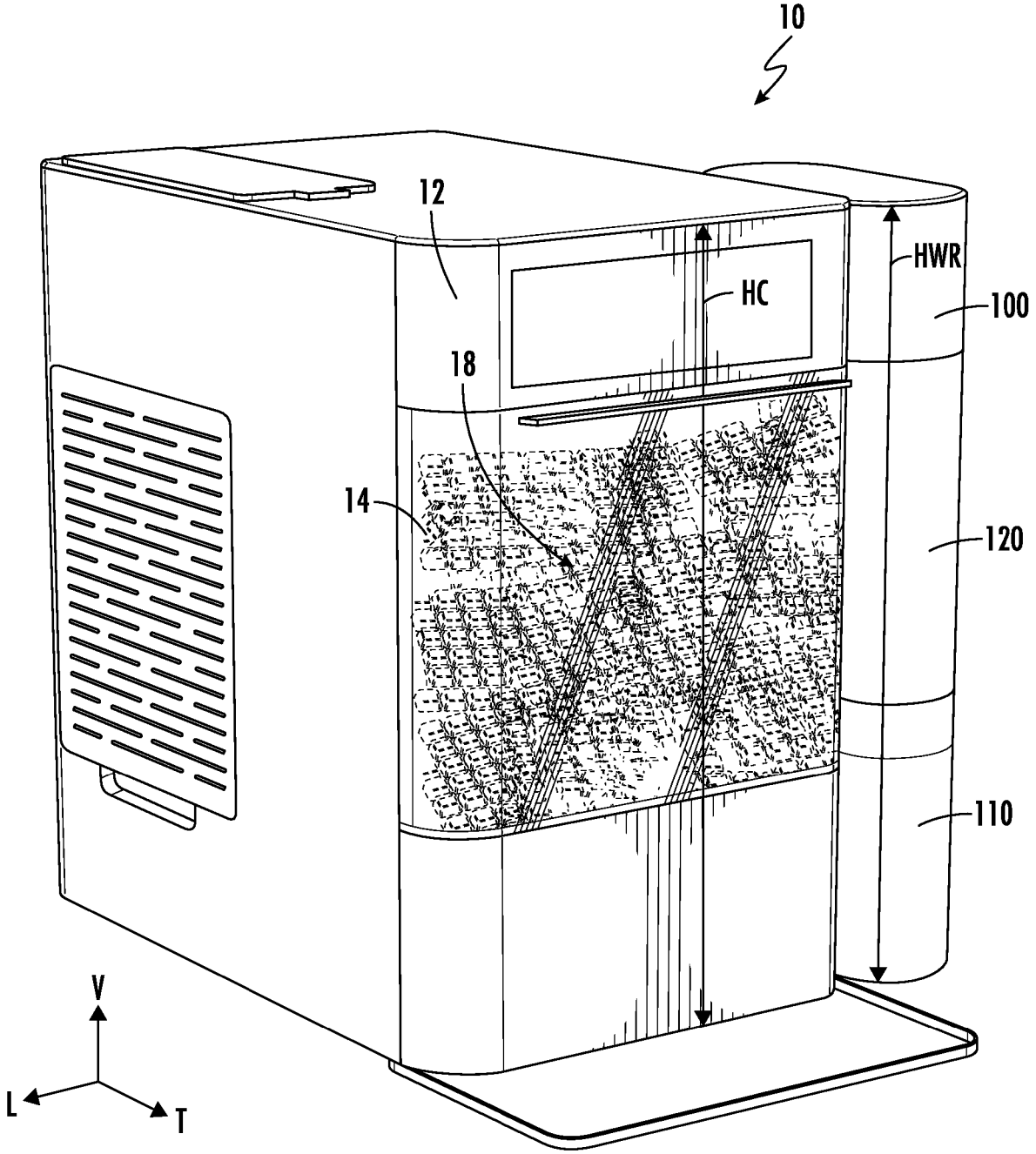
FIG. 1 is a perspective view of an appliance according to an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
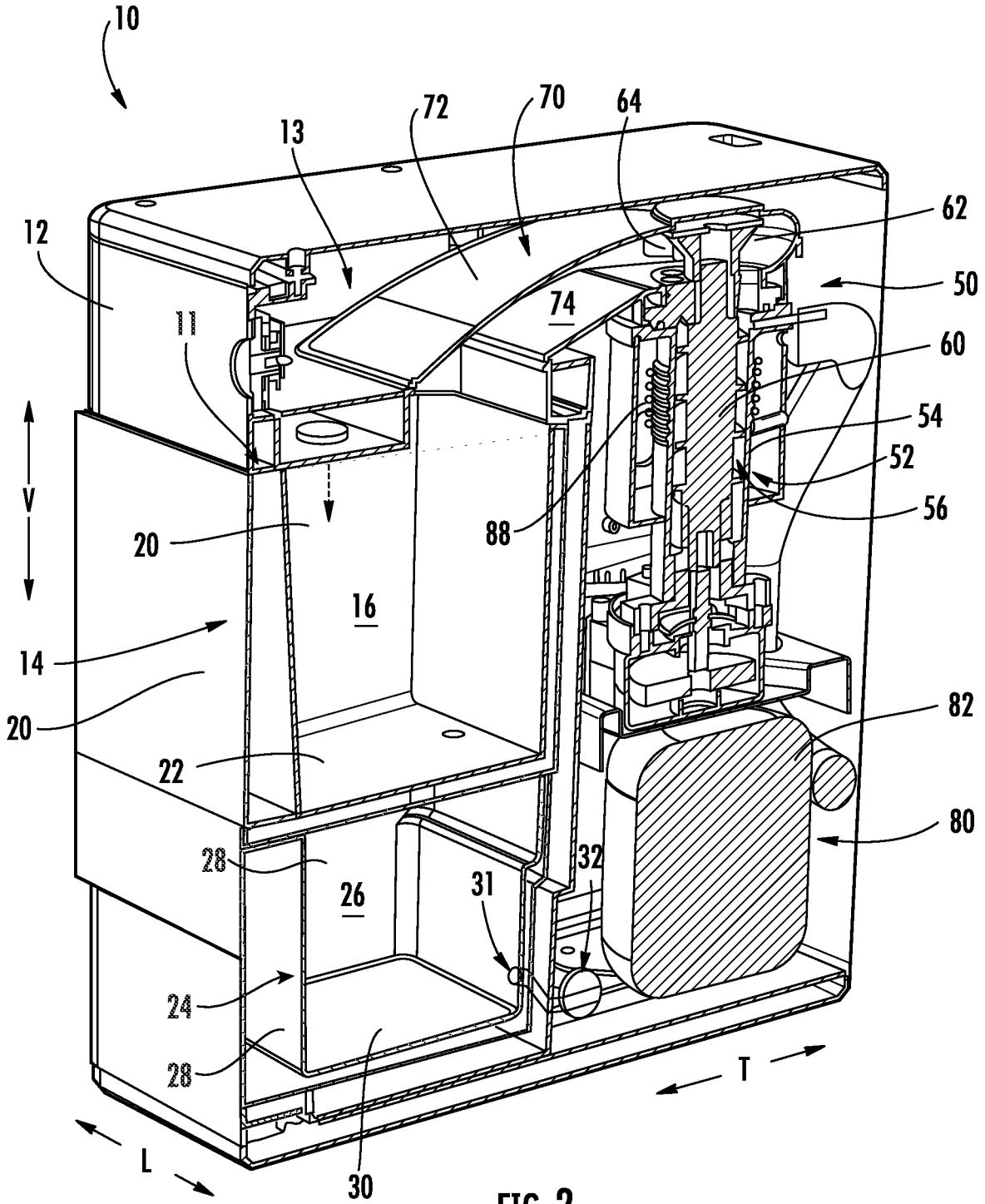
FIG. 2 is a perspective section view of the example appliance of FIG. 1.
Figure 3:
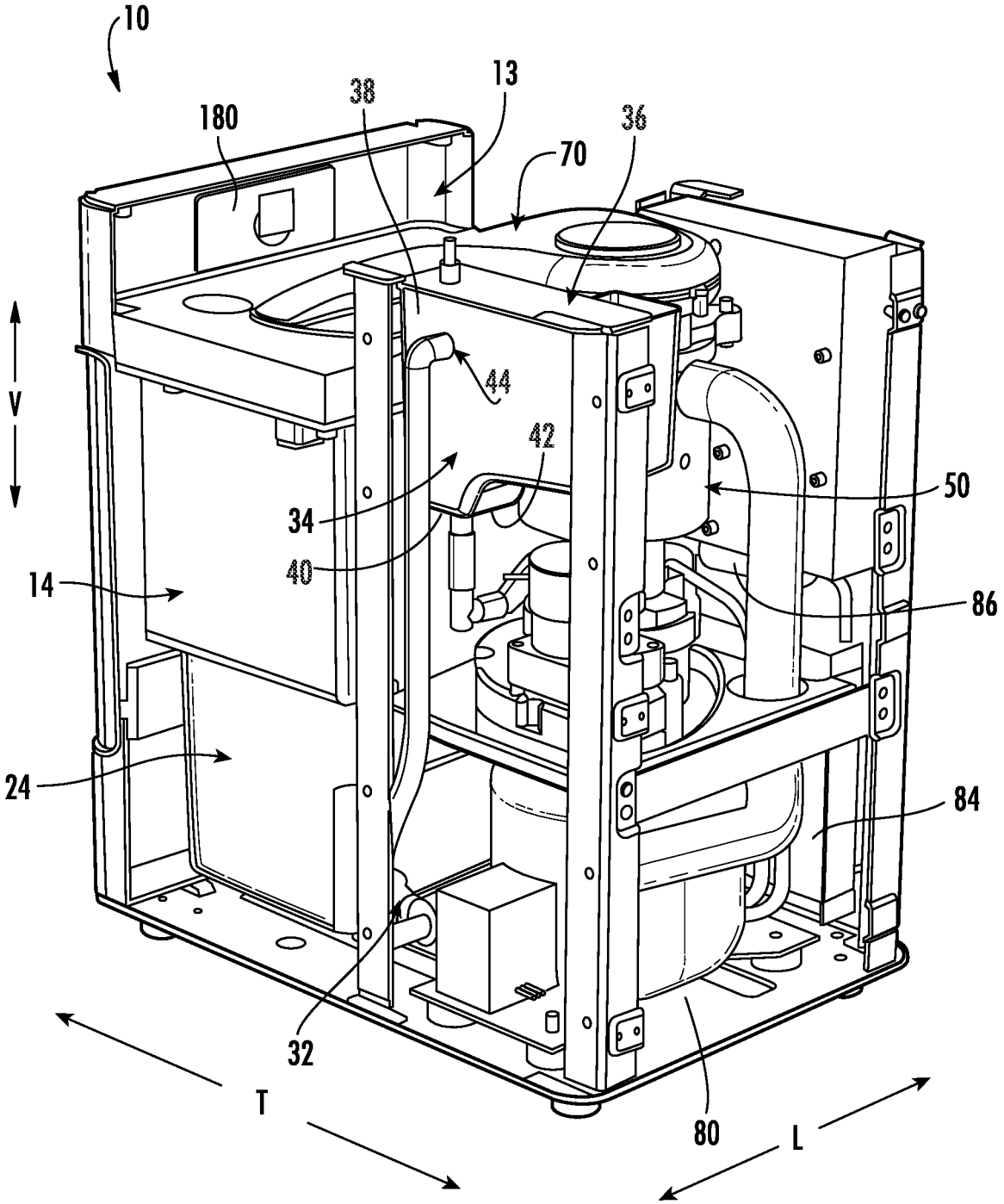
FIG. 3 is a rear perspective view of the example appliance of FIG. 1 with a casing of the example appliance removed to show interior components of the example appliance.

Referring now to FIGS. 1 through 3, one embodiment of an appliance 10 in accordance with the present disclosure is illustrated. As shown, appliance 10 is provided as a stand-alone ice making appliance embodiment. Appliance 10 includes an outer casing 12 which defines a primary opening 11 (e.g., first primary opening) and an internal cavity or volume 13. Internal volume 13 generally at least partially houses various other components of the appliance 10 therein. Primary opening 11 defined in outer casing 12 may extend internal volume 13 to an ambient environment. Through primary opening 11, access (e.g., by a user) to the internal volume 13 may be permitted. Outer casing 12 further defines a vertical direction V, a lateral direction L, and a transverse direction T. The vertical direction V, lateral direction L, and transverse direction T are mutually perpendicular and form an orthogonal direction system.

A container 14 of appliance 10 is also illustrated. Container 14 defines a first storage volume 16 for the receipt and storage of ice 18 therein. A user of the appliance 10 may access ice 18 within the container 14 for consumption or other uses, as described in detail below. Container 14 may include multiple walls, including one or more sidewalls 20 and a base wall 22, which may together define the first storage volume 16. In example embodiments, at least one sidewall 20 may be formed in part from a clear, see-through (i.e., transparent or translucent) material, such as a clear glass or plastic, such that a user can see into the first storage volume 16 and thus view ice 18 therein. For instance, at least one sidewall 20 may include a separate external panel and internal panel formed from a clear, see-through (i.e., transparent or translucent) material, such as a clear glass or plastic. Further, in example embodiments, container 14 may be removable, such as from the outer casing 12, by a user. This facilitates advantageous easy access by the user to ice within the container 14, as discussed below.

As discussed herein, appliance 10 is configured to make nugget ice, which is becoming increasingly popular with consumers. Ice 18 may be nugget ice. Generally, nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Still referring to FIGS. 1 through 3, various components of appliance 10 in accordance with the present disclosure are illustrated. For example, as mentioned, appliance 10 includes a water tank 24. The water tank 24, which may be referred to as a first water tank, defines a second storage volume 26 for the receipt and holding of water. Water tank 24 may include multiple walls, including one or more sidewalls 28 and a base wall 30, which may together define the second storage volume 26. In example embodiments, the water tank 24 may be disposed below the container 14 at a bottom portion of the casing 12 along the vertical direction V defined for the appliance 10, as shown.

As discussed, in example embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through a fluid outlet 31 defined in the water tank 24, such as in a sidewall 28 thereof, and may flow through a conduit to and through pump 32. Pump 32 may, when activated, actively flow water from the second storage volume 26 therethrough and from the pump 32.

Water actively flowing from the pump 32 may be flowed through a suitable conduit, such as a flexible tubing conduit supply line 102, to a reservoir 34, otherwise referred to as a second water tank disposed within casing 12. For example, reservoir 34 may define a third storage volume 36. In some embodiments, third storage volume 36 is defined by one or more sidewalls 38 and a base wall 40. Third storage volume 36 may, for example, be in fluid communication with the pump 32 and may thus receive water that is actively flowed from the water tank 24, such as through the pump 32. During operation, water may be flowed into the third storage volume 36 through an opening 44 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through an opening 42 and through suitable conduits, from third storage volume 36 to ice maker 50.

Ice maker 50 generally receives water, such as from reservoir 34, and freezes the water to form ice 18. In example embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening may be defined in a sidewall 54. Water may be flowed from third storage volume 36 through the opening (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in example embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provided to the container 14. In example embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72, which defines a passage 74 therethrough. Ice 18 may be directed from the ice maker 50 (such as from the auger 60 and/or extruder 62) through the passage 74 to the container 14. In some embodiments, for example, a sweep 64, which may be connected to and rotate with the auger, may contact the ice emerging through the extruder 62 from the auger 60 and direct the ice 18 through the passage 74 to the container 14.

As discussed, water within the casing 52 may at least partially freeze due to heat exchange, such as with a refrigeration system. In example embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof.

It should additionally be noted that, in example embodiments, a controller 200 may be in operative communication with the sealed system 80, such as with the compressor 82 thereof, and may activate the sealed system 80 as desired or required for ice making purposes.

In example embodiments, controller 200 is in operative communication with the pump 32. Such operative communication may be via a wired or wireless connection, and may facilitate the transmittal and/or receipt of signals by the controller 200 and pump 32. Controller 200 may be configured to activate the pump 32 to actively flow water. For example, controller 200 may activate the pump 32 to actively flow water therethrough when, for example, reservoir 34 requires water. A suitable sensor(s), for example, may be provided in the third storage volume 36. The sensor(s) may be in operative communication with the controller 200 and may be configured to transmit signals to the controller 200, which indicate whether or not additional water is desired in the reservoir 34. When controller 200 receives a signal that water is desired, controller 200 may send a signal to pump 32 to activate pump 32.

As shown in FIG. 1, appliance 10 may also include an auxiliary water reservoir 100. In general, a height HWR of auxiliary water reservoir 100 may be about equal to a height HC of casing 12. Thus, the appearance of auxiliary water reservoir 100 may complement casing 12. Auxiliary water reservoir 100 is disposed outside of casing 12. For example, auxiliary water reservoir 100 may be mounted at a side of casing 12. Thus, while most components of appliance 10 are housed within casing 12, auxiliary water reservoir 100 is positioned outside of casing 12. In certain example embodiments, auxiliary water reservoir 100 may include a base 110 and a container 120. Base 110 may be attached to casing 12, e.g., at the side of casing 12 adjacent the bottom of casing 12. For instance, base 110 may be clipped, fastened, etc. to casing 12. Container 120 is removably mounted to base 110. For example, a bottom portion 122 of container 120 may be received within base 110 to mount container 120 on base 110. A user may lift upwardly on container 120 to remove container 120 from base 110, and the user may insert bottom portion 122 of container 120 into base to mount container 120 on base 110. As an example, the user may remove container 120 from base 110 in order to conveniently fill container 120 with water at a faucet.

Auxiliary water reservoir 100 may be in fluid communication with a water tank within casing 12 such that water within auxiliary water reservoir 100 is flowable to the water tank. For example, supply line 102 may extend from auxiliary water reservoir 100 to water tank 24, and water from within auxiliary water reservoir 100 may flow from auxiliary water reservoir 100 into second storage volume 26 via supply line 102. It will be understood that appliance 10 may be plumbed in any other suitable manner to deliver water from auxiliary water reservoir 100 into casing 12 for use with ice maker 50 in alternative example embodiments.

In some example embodiments, an ice making appliance may generally include any suitable combination of the various components described above, such as a casing, a water tank, and an ice maker with an inlet. Ice making appliances may also include a fitting comprising two or more ports, and a flexible tubing conduit that includes a tube extending from one port of the fitting and a tube extending from another port of the fitting. In general, one of the ports of the fitting is in fluid communication with the water tank, and another port of the fitting is in fluid communication with the inlet of the ice maker. More specifically, the tube of the flexible tubing conduit between the inlet of the ice maker and one of the ports of the fitting comprises an internal diameter greater than an internal diameter of the other tube between the other port of the flexible tubing conduit and the water tank. The flexible tubing conduit and fitting will be further described herein.

Figure 4:
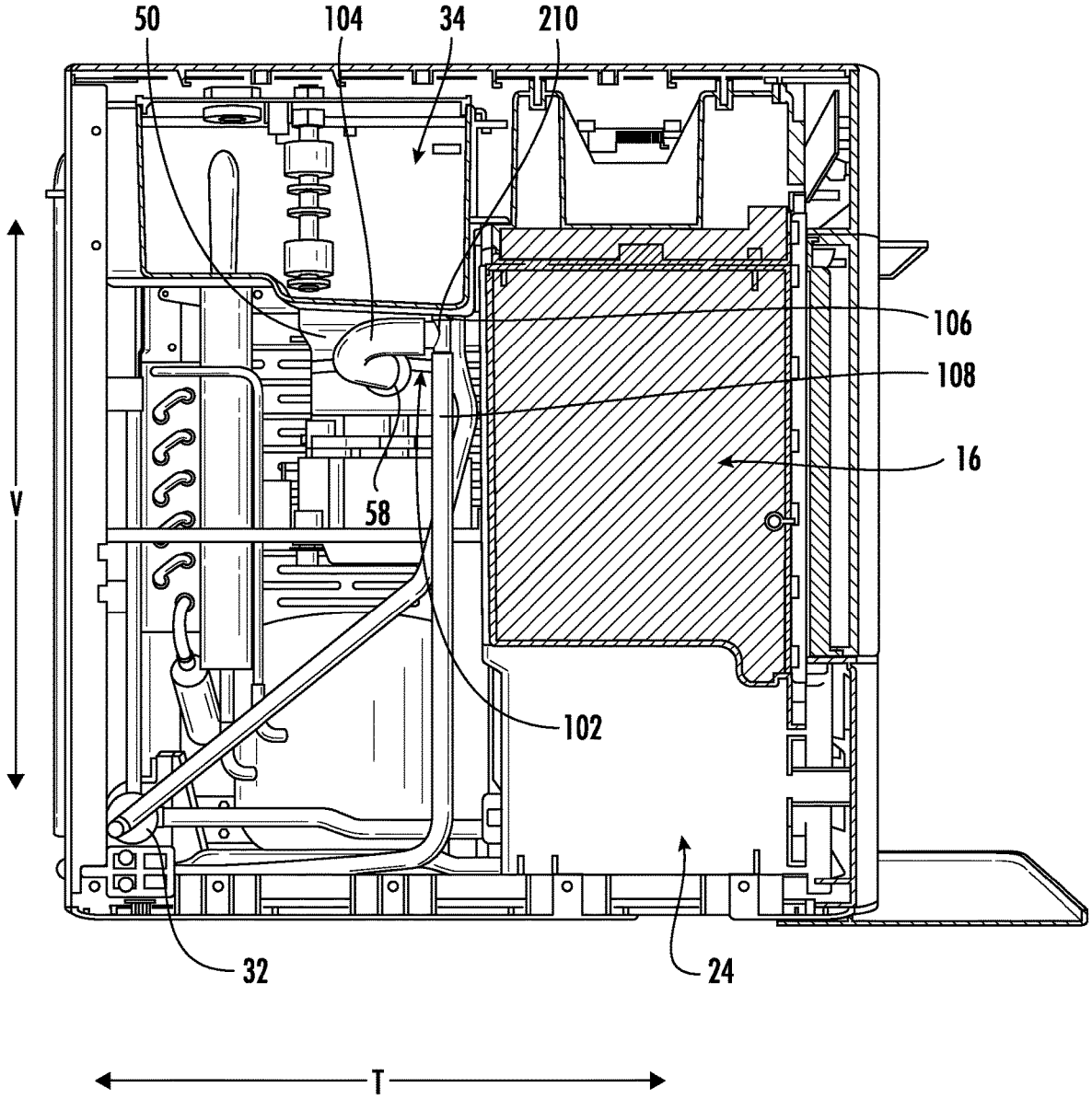
FIG. 4 is a side perspective view of the example appliance of FIG. 1 with a casing of the example appliance removed to show interior components of the example appliance.
Figure 5:
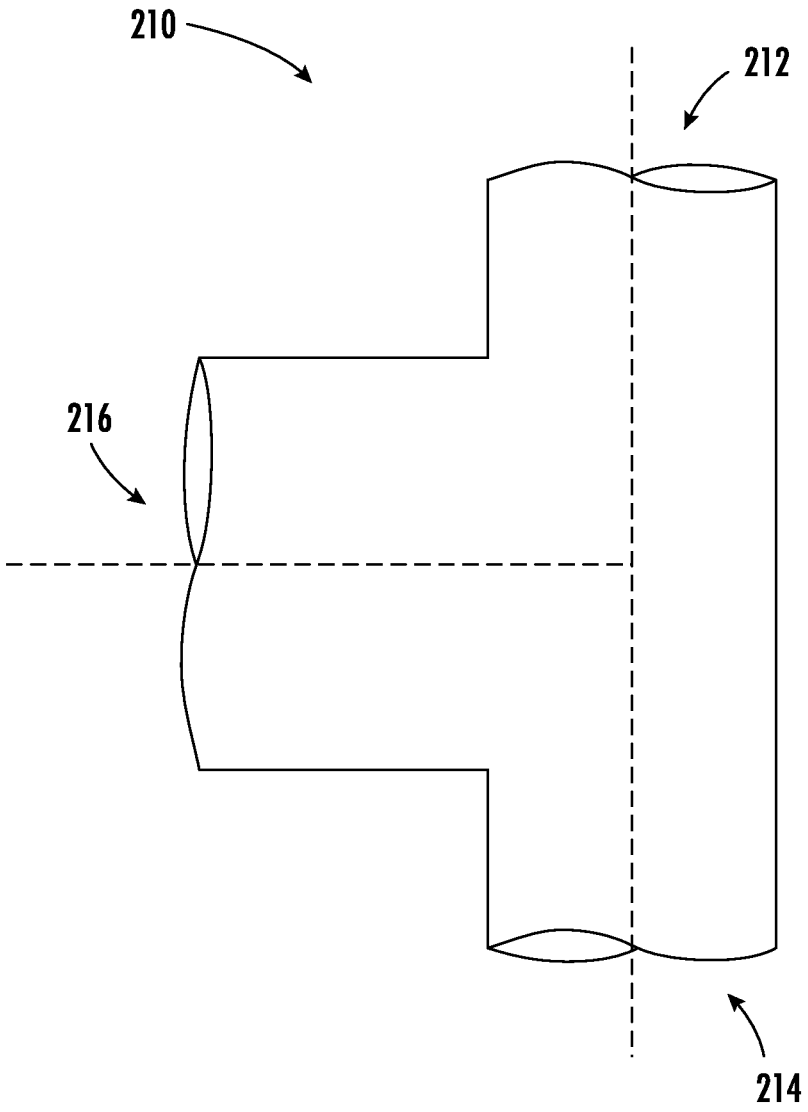
FIG. 5 is a schematic view of a fitting of the example appliance of FIG. 1 according to aspects of the present disclosure.

Referring now to FIGS. 4 and 5, in the present example embodiment, the stand-alone ice making appliance 10 may generally include a fitting 210 positioned on supply line 102. Fitting 210 may be in fluid communication with water tank 24, reservoir 34, and ice maker 50. Particularly, fitting 210 may be a T-fitting with a first port 212, a second port 214 below the first port in the vertical direction, and a third port 216 between the first and second ports 212, 214 in the vertical direction. The first port 212 of fitting 210 may be in fluid communication with the reservoir 34, and the second port 214 of the fitting 210 may be in fluid communication with water tank 24. The third port 216 of the fitting 210 may be in fluid communication with an inlet 58 of the ice maker 50. More specifically, flexible tubing conduit supply line 102 may include a first tube 106 extending from the first port 212 of the fitting 210 to the reservoir 34, a second tube 108 extending from the second port 214 of the fitting 210 to water tank 24, and a third tube 104 extending from the third port 216 of the fitting 210 to the inlet 58 of the ice maker 50. In some embodiments, as shown in FIG. 4, an internal diameter of the first tube 106 and an internal diameter of the second tube 108 are approximately identical. Moreover, the third tube 104 of the flexible tubing conduit supply line 102 may have an internal diameter greater than the internal diameter of the first tube 106 and the second tube 108. For example, the internal diameter of third tube 104 may be between one quarter centimeter (0.25 cm) and two and a half centimeters (2.5 cm), such as between three-quarter centimeter (0.75 cm) and two (2 cm), or such as between one centimeter (1 cm) and one and a half centimeters (1.5 cm).

In example embodiments, the third port 216 of the fitting 210 may be approximately perpendicular to the vertical direction, and/or the first port 212 and second port 214 of the fitting 210 may be colinear and the third port 216 may be perpendicular to the first port 212 and the second port 214.

For example, the first port 212 and the second port 214 may be colinear on a line oriented along or approximately parallel to the vertical direction V, while the third port 216 is approximately perpendicular to the first port 212 and the second port 214 and to the vertical direction V. As stated above, ice maker 50 generally receives water, such as from reservoir 34, and freezes the water to form ice 18. In example embodiments, ice maker 50 receives water from reservoir 34 via water flowing from reservoir 34, through fitting 210 to inlet 58 of ice maker 50.

However, when air bubbles flowing from water tank 24 are introduced into ice maker 50 this can allow for air gaps throughout auger 60 in the ice maker 50. When the water in auger 60 starts to freeze with bubbles, the bubbles may start to accumulate near the extruder 62, which may cause the top of the extruder 62 to freeze. The air gaps prevent ice from being able to exit through the extruder 62, which may result in a frozen ice maker 50 that is not producing any ice. In order to advantageously reduce air bubbles flowing into ice maker 50, the second water tank, reservoir 34, may generally be positioned above, in the vertical direction, the inlet 58 of the ice maker, such as toward a top portion of the casing 12. Further, the third port 216 of the fitting 210 may be positioned above inlet 58 of ice maker 50 in the vertical direction. In particular, positioning fitting 210 such that third port 216 is above inlet 58 of ice maker 50 may advantageously reduce air bubbles flowing into ice maker 50. Moreover, flexible tubing conduit supply line 102 may extend from the third port 216 of the fitting 210 to the inlet 58 of the ice maker 50. For example, when making ice, gravity may sequentially push water from the second water tank, reservoir 34, through the first tube 106, through fitting 210, through third tube 104, and into inlet 58 of ice maker 50.

As may be seen from the above, a stand-alone ice making appliance with a tube extending from a fitting with a greater internal diameter than the other tubes attached to the fitting may advantageously reduce air bubbles flowing into ice maker. The diameter of the tube may prevent bubbles from being able to escape towards the ice maker and rather more easily flow to the above reservoir. The larger diameter will generally reduce the ability to trap an air bubble. The transition from the tubing to the upper reservoir may have an adequate inside diameter to allow the air bubble to escape to the upper reservoir. Once the air bubbles reach the reservoir, the bubbles can release (pop) within the reservoir, allowing for smooth water flow from the reservoir to the ice maker and advantageously reduce air bubbles flowing into ice maker. Preventing the freeze-up of the ice maker further advantageously reduces very loud squealing noises from the ice maker that are a consumer dissatisfier.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance defining a vertical direction, a lateral direction, and a transverse direction, wherein the vertical direction, the lateral direction, and the transverse direction are mutually perpendicular, comprising:

a casing;

a first water tank disposed within the casing;

a second water tank in fluid communication with the first water tank;

a pump disposed within the casing, the pump in fluid communication with the first water tank and the second water tank, the pump operable to flow water from the first water tank to the second water tank;

an ice maker disposed within the casing, the ice maker comprising an inlet;

a fitting comprising a first port, a second port below the first port in the vertical direction, and a third port between the first and second ports in the vertical direction; and a flexible tubing conduit comprising a first tube extending from the first port of the fitting, a second tube extending from the second port of the fitting, and a third tube extending from the third port of the fitting, wherein the first port of the fitting is in fluid communication with the second water tank, the second port of the fitting is in fluid communication with the first water tank, and the third port of the fitting is in fluid communication with the inlet of the ice maker, and wherein the third tube of the flexible tubing conduit comprises an internal diameter greater than one or more of an internal diameter of the first tube and an internal diameter of the second tube.

2. The stand-alone ice making appliance of claim 1, wherein the fitting is a T-fitting.

3. The stand-alone ice making appliance of claim 1, wherein the internal diameter of the first tube and the internal diameter of the second tube are approximately identical.

4. The stand-alone ice making appliance of claim 1, wherein the first water tank is disposed at a bottom portion of the casing.

5. The stand-alone ice making appliance of claim 1, wherein the second water tank is positioned above, in the vertical direction, the inlet of the ice maker.

6. The stand-alone ice making appliance of claim 5, wherein, when making ice, gravity pushes water sequentially from the second water tank through the first tube, through the fitting, through the third tube, and into the inlet of the ice maker.

7. The stand-alone ice making appliance of claim 1, wherein the third port of the fitting is perpendicular to the vertical direction.

8. The stand-alone ice making appliance of claim 1, wherein the first port and second port of the fitting are colinear and the third port is perpendicular to the first port and the second port.

9. The stand-alone ice making appliance of claim 1, wherein the internal diameter of the third tube is between one quarter centimeter and two and a half centimeters.

10. The stand-alone ice making appliance of claim 1, further comprising an auger disposed in the ice maker, the auger configured to lift partially frozen water through the ice maker.

* * * * *